United States Patent [19]

Jeschke et al.

[11] Patent Number: 4,881,181

[45] Date of Patent: Nov. 14, 1989

[54] PROCESS FOR THE DETERMINATION OF CONTROLLED VARIABLES FOR THE INKING UNIT OF PRINTING PRESSES

[75] Inventors: Willi Jeschke, Heidelberg; Gerhard Löffler, Walldorf, both of Fed. Rep. of Germany

[73] Assignee: Heidelberger Druckmaschinen Aktiengesellschaft, Heidelberg, Fed. Rep. of Germany

[21] Appl. No.: 136,210

[22] Filed: Dec. 21, 1987

[30] Foreign Application Priority Data

Dec. 20, 1986 [DE] Fed. Rep. of Germany ..... 3643720

[51] Int. Cl.[4] ..... B41F 31/04

[52] U.S. Cl. ..... 364/519; 101/365; 101/211; 101/483; 356/406

[58] Field of Search ..... 364/519, 526; 101/207–211, 350, 365, 426, DIG. 25; 356/402, 403, 406–408; 250/555

[56] References Cited

U.S. PATENT DOCUMENTS

| | | | |
|---|---|---|---|
| 3,393,618 | 7/1968 | Baker | 95/1 |
| 3,995,958 | 12/1976 | Pfahl et al. | 101/365 X |
| 4,200,932 | 4/1980 | Schramm et al. | 364/519 |
| 4,469,025 | 9/1984 | Löffler et al. | 101/171 |
| 4,505,589 | 3/1985 | Ott et al. | 356/402 |
| 4,541,336 | 9/1985 | Bernauer | 101/211 |
| 4,570,539 | 2/1986 | Rottstedt | 101/DIG. 25 X |
| 4,586,148 | 4/1986 | Rehder et al. | 364/519 X |
| 4,606,633 | 8/1986 | Jeschke et al. | 356/237 |
| 4,637,728 | 1/1987 | Kipphan et al. | 101/211 X |
| 4,649,502 | 3/1987 | Keller et al. | 364/519 |
| 4,660,470 | 4/1987 | Kramp et al. | 101/426 |

OTHER PUBLICATIONS

"A Color Proofing Update", American Printer, M. Bruno, Jul. 1985.

"GATF Compact Color Test Strip", Research Progress, Z. Elyjiw, 79, 8/1968.

*Primary Examiner*—David L. Clark

*Attorney, Agent, or Firm*—Nils H. Ljungman

[57] ABSTRACT

A process which makes possible a zonal ink control with the use of print control strips with single, double, or multizone repetition cycle of the measurement fields, and by means of which controlled variables can also be determined according to measurement strips without zonal separation for all ink zones. Substitute measurement values are formed by interpolation for each ink zone from determined measurements and from their lateral position in relation to the corresponding ink zones, and these substitute measurements are compared with setpoints, and the difference is used to determine controlled variables.

21 Claims, 11 Drawing Sheets

14

PROCESS FOR THE DETERMINATION OF CONTROLLED VARIABLES FOR THE INKING UNIT OF PRINTING PRESSES

BACKGROUND OF THE INVENTION

1. Field of the Invention

The present invention relates to a process for the determination of controlled variables for the inking unit of printing presses, by means of an ink control and regulation system with ink measurement devices, such as densitometers, for the zone-wise determination of measured values for the printed inks by means of print control strips, which are printed on the printed sheet, whereby the zonally-determined measured values are compared with specified zonal values and zonal variances are determined, taking specified tolerances into account. The individual ink zones are then controlled on the basis of the zonal variances, according to determined algorithms.

With the print control strips used here, single color solid tone (or top tone) measurement fields in each ink zone are primarily used for zonal control and regulation according to the measured values determined. "Solid tone regulation" is advantageous primarily because the only variable involved in the solid tone measurement, or DV, is the saturation as a measurement of the thickness of the ink layer. The classification of the measured value within the printing process is therefore clear. A disadvantage of pure solid tone control is that in spite of the same solid tone density, the printed product and the master, observed visually, do not necessarily agree. There are a number of reasons for this, e.g., different inks, different printing stocks, etc.

Practical tests have determined that when using single color dot halftone fields for ink regulation, in many cases, but not always, a better agreement can be achieved between the master and the printed copy, although variables can also enter into the halftone density value (or DR or screen density) which are independent of the coloration itself. These include the pressure between the plates and rubber blanket cylinder, the printing stock, the rubber blanket, the wetting agent and the wetting agent delivery, the printing plate, as well as slip and doubling.

Values derived from the solid tone density (DV) and the halftone density (DR) can also be used for the ink regulation. By means of the Murray-Davies equation, the tonal value of the printed area (or the tonal value of the printed halftones) can be determined from DV and DR as a controlled variable: $F=(1-10^{-DR}):(1-10^{-DV})$.

Both in regulation according to DR and also in that based on the tonal value of the printed area F, measurement strips are used in which single color dot halftone fields are present for all printing inks in each ink zone. In contrast to the DV regulation, where the solid tone fields dominate in the measurement strips, halftone fields predominate here. All the other fields are present less frequently.

2. Description of the Prior Art

In such ink control and regulation systems (German Laid Open Patent Appln. No. DE-OS 27 28 738), zonal variances are determined on the basis of zonally determined measured values for the printed inks and zonal setpoints, taking into consideration the specified tolerances. From these variances, and on the basis of specified algorithms for the relationship between measurements and ink gap, and on the basis of the ink ductor as a function of the ink gap set and the ink strip set, a new adjustment of the ink gap and/or of the ink strip is determined. The ink measurement devices used for this purpose, such as a scanning densitometer and a multichannel densitometer, determine the measurement location in addition to the measured values. According to purely geometric functions, the location is assigned to an ink zone, corresponding to the ink zone distribution of the machine in question.

In another embodiment of the prior art (German Utility Model No. DE-GM 77 19 012), a "two-zone" print control strip is used, which is provided only for the measurement and the indication of measurements by ink zone.

Therefore, on all the ink regulation systems used up to now, print control strips are exclusively used which exhibit corresponding solid tone or halftone fields in each ink zone. This has a series of disadvantages with regard to costs, flexibility and the amount of date to be processed.

3. Description of Related Arts

In European Patent Appln. No. RS 74162 CH, an ink control and regulation process is described which is based on chromatometry/colorimetrics, in which multicolor dot halftone fields are used to particular advantage. The measurement apparatus proposed for the execution of this process allow, in addition to the recording of spectra, also their digital filtering, like that performed by ordinary densitometer color filters. Thereby, a selection can be made between control/regulation according to spectral measured values from single or multicolored dot halftone fields or single color solid tone fields, or control/regulation based on densitometric measured values from the same fields. Preferably, a "colorimetric tuning" is conducted, i.e., the printed copy and the master are brought into agreement, and the production run is monitored densitometrically.

Since the various measurement fields for the individual colors in the measurement strip are necessarily located next to one another, the measurement locations are often very different in relation to the ink zone center, for example, and their assignment to a determined ink zone cannot be clearly determined by the process, at least if the measurement point is close to the boundary of the ink zone. Such a measurement value could be unquestionably assigned to either ink zone. If we also take into consideration the lateral compensation by the traversing distributing cylinder of the printing press, which as a rule exhibits a distribution distance which is greater than the width of the ink zone, then the inconclusive nature of the assignment of the measured value and the questionability of the representative nature of the measurement for the zone to which it is assigned becomes clear.

In the so-called "two-zone measurement", in which on the measurement strip, there are solid tone measurement fields for each color in each second ink zone, the zonal color compensation which occurs on account of the lateral distribution is utilized. In general, the lateral distribution distance is the same as the width of one ink zone, plus a slight overrun. Practice has shown that on the basis of a "two-zone measurement", the ink delivery can be controlled manually with sufficient precision.

OBJECTS OF THE INVENTION

An object of the invention is to develop a process which makes possible a zonal ink control and regulation, using print control strips with single, double or multizone repetition cycle of the measurement fields, and in which the controlled variables can also be determined using measurement strips without zonal separation for all ink zones.

It is another object of the present invention to provide a process to control the application of ink in a printing press through the analysis of a variety of print control strips, regardless of the relative positioning of the measurement fields of the print control strip or of the ink zones of the printing press.

Yet another object of the present invention is the provision of an ink application adjustment process for a printing press which rapidly converges toward production quality ink metering duct settings, and which may also be used to monitor quality.

A still further object of the present invention is the provision of an automated ink application adjustment process for a printing press.

SUMMARY OF THE INVENTION

The principal object is achieved in that substitute measured values for each ink zone are formed by interpolation from the measured values and from their lateral position in relation to the corresponding ink zones, and that the substitute measured values are compared with the zonal setpoints and used, taking tolerances into consideration, for the calculation of the controlled variables for each ink zone. Such a process can be applied universally, regardless of whether the measurement strips are tuned to a ink zone division, and regardless of where the relative measurement fields are located in relation to the center of the ink zone, for example. Therefore, any suitable point in the image can be used to calculate the controlled variables. Since there are all sorts of different measurement strips commercially available with different divisions, the invention offers significant advantages for the printer, all the more so since printing presses by different manufacturers exhibit different ink zone divisions. The process takes advantage of the fact that on account of the lateral color distribution of the distribution rollers in the ink unit, soft transitions are achieved from ink zone to ink zone, so that in the lateral direction, there are continuous color transitions and no sudden color jumps. manipulated variables if, in a "two-zone measurement" for example, only one-half of the measurements need to be recorded and processed. For on-line measurement with a multichannel measurement apparatus, the hardware costs can thereby be reduced to one-half, while maintaining the same control quality.

In general, the invention features a process for controlling the application of at least one printing medium to a receptor for receiving the at least one printing medium in a printing device. The printing device has a printing medium metering device for metering the at least one printing medium to a plurality of printing medium zones arranged in a geometrical configuration with respect to the printing receptor. Each of the printing medium zones have a coordinate $X'_i$ representing the spatial position of a predetermined area of the printing medium zone with respect to the printing receptor. The process comprises the steps of: (a) producing a print control image with the printing device, the print control image having printed thereon, by the printing device, a plurality of measurement fields of the at least one printing medium, each of the measurement fields having a coordinate $X_i$ representing its spatial position with respect to the printing receptor; (b) analyzing the plurality of measurement fields produced on the print control image to obtain a plurality of printing medium related values $M_i$, each printing medium related value $M_i$ being indicative of the application of the at least one printing medium at each of the spatial positions $X_i$; (c) relating a numerical function to the measured values $X_i$ and $M_i$; (d) determining values $M'_i$ of the numerical function at the coordinates $X'_i$ representing the spatial positions of the predetermined areas of the printing medium zones with respect to the printing receptor; and (e) adjusting the printing medium metering device in accordance with the determined values $M'_i$.

In another aspect, the invention features a process for controlling the application of at least one ink in a printing press, the printing press having a plurality of ink metering ducts arranged laterally with respect to the printing press. Each of the plurality of ink metering ducts substantially defines an ink zone of the printing press. Each of the ink zones has a coordinate $X'_i$ representing the lateral position of its center point with respect to the printing press. The process comprises the steps of: (a) producing a print control strip with the printing press, the print control strip having printed thereon, by the printing press, a plurality of measurement fields of the at least one ink, each of the measurement fields having a coordinate $X_i$ representing its lateral position with respect to the printing press; (b) analyzing the plurality of measurement fields produced on the print control strip to obtain a plurality of color related values $M_i$, each color related value $M_i$ being indicative of the application of the at least one ink within the printing press at each of the lateral positions $X_i$; (c) fitting a mathematical curve to the measured values $X_i$ and $M_i$; (d) determining values $M'_i$ of the mathematical curve at the coordinates $X'_i$ representing the lateral positions of the ink zones with respect to the printing press; and (e) adjusting the ink metering ducts in accordance with the determined values $M'_i$.

In a still further aspect, the invention features a process for controlling the application of at least one ink in a printing press, the printing press having at least two ink metering ducts arranged laterally with respect to the printing press, each of the at least two ink metering ducts substantially defining an ink zone of the printing press, each of the ink zones having a coordinate $X'_i$ representing the lateral position of its center point with respect to the printing press, the ink zones being consecutive and separated by borders. The process comprises the steps of: (a) producing a print control strip with the printing press, the print control strip having printed thereon by the printing press at least one measurement field of the at least one ink, the at least one measurement field being positioned laterally with respect to the printing press adjacent the boundary between the at least two ink zones; (b) analyzing the at least one measurement field to obtain a color related value indicative of the application of the at least one ink at substantially the lateral position of the measurement field; (c) assigning the obtained color related value to the at least two ink zones; and (d) adjusting the at least two corresponding ink metering ducts based on the assigned color related value.

Embodiments of the invention are schematically illustrated in the drawings.

Figure 3A:
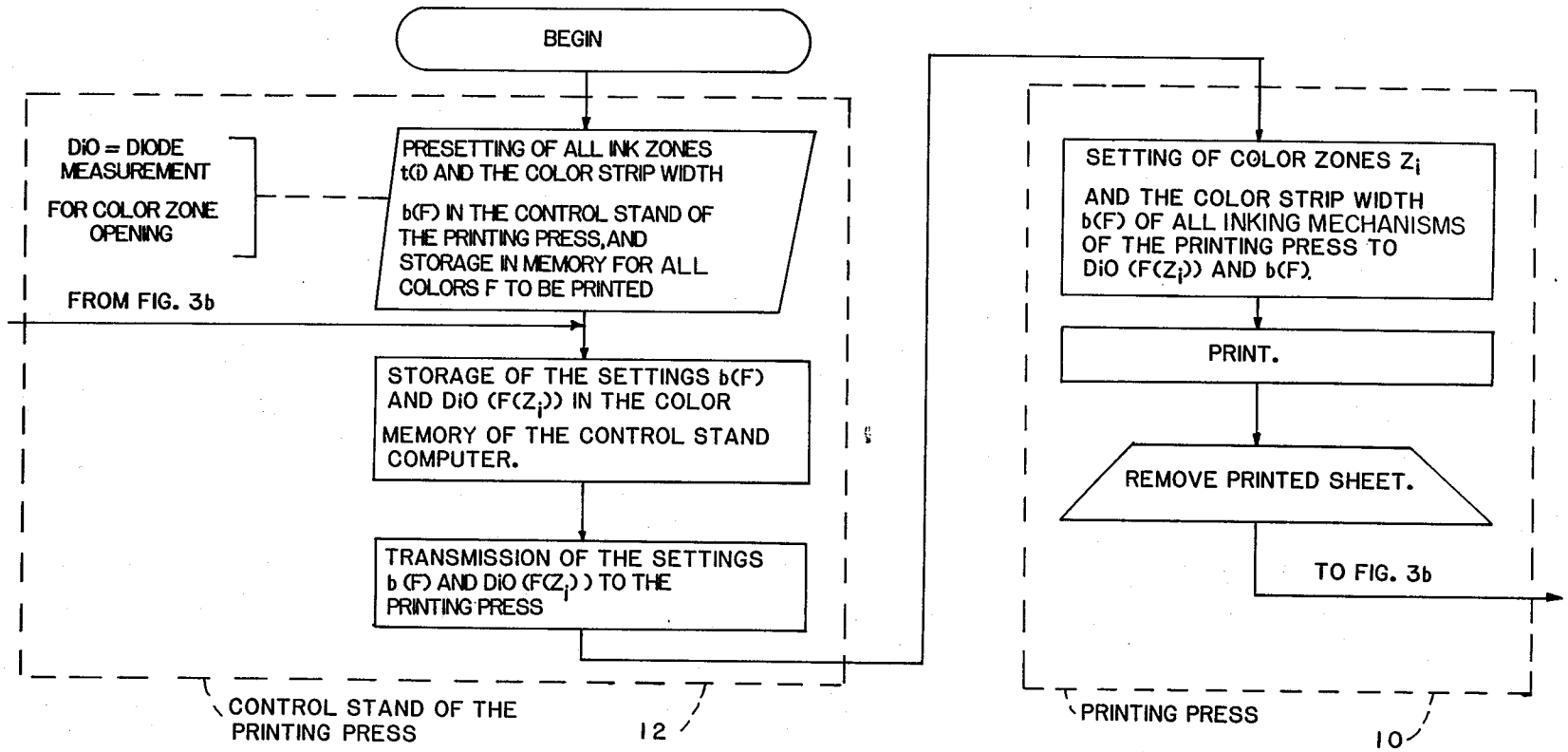
Figure 3B:
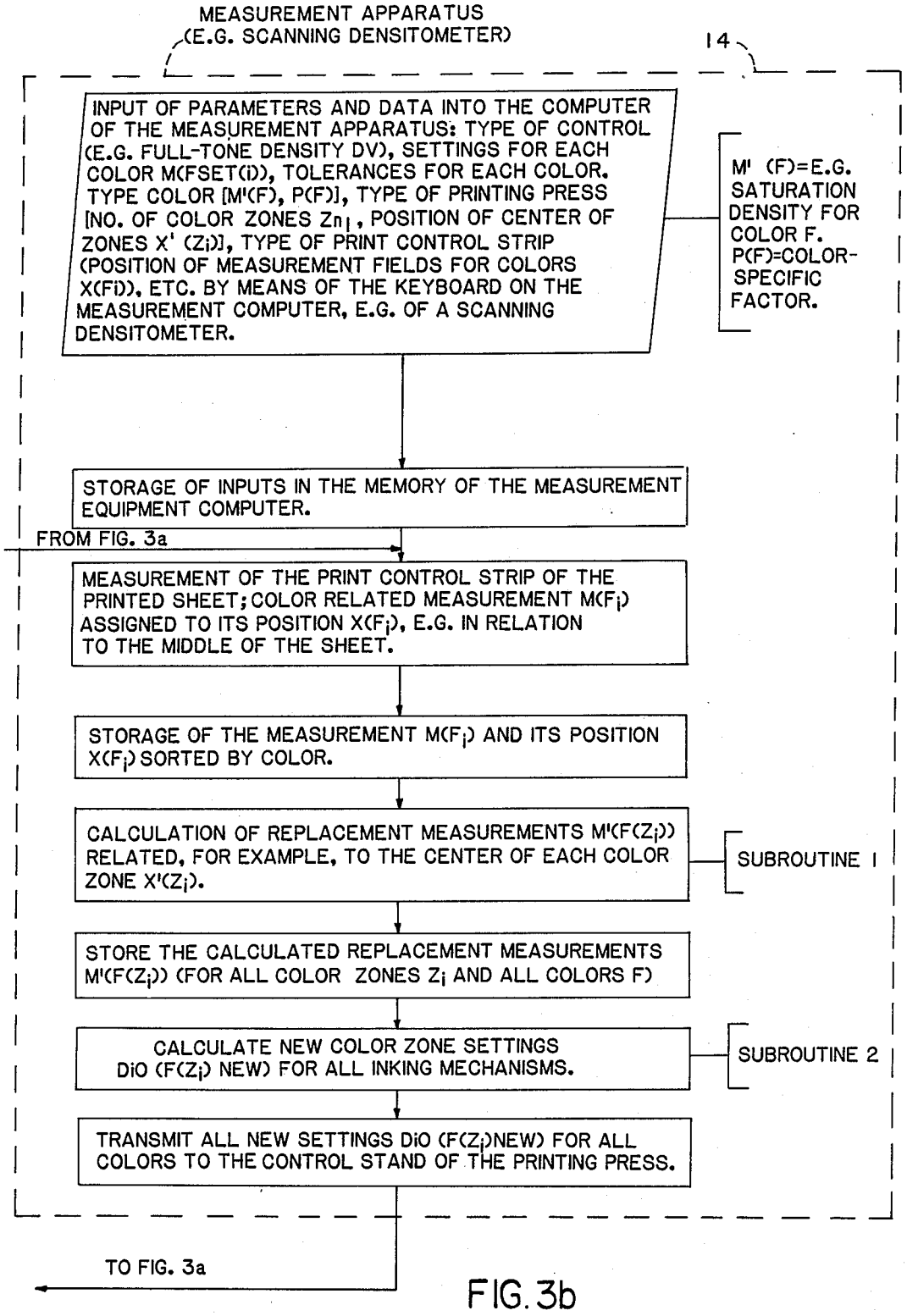
Figure 4:
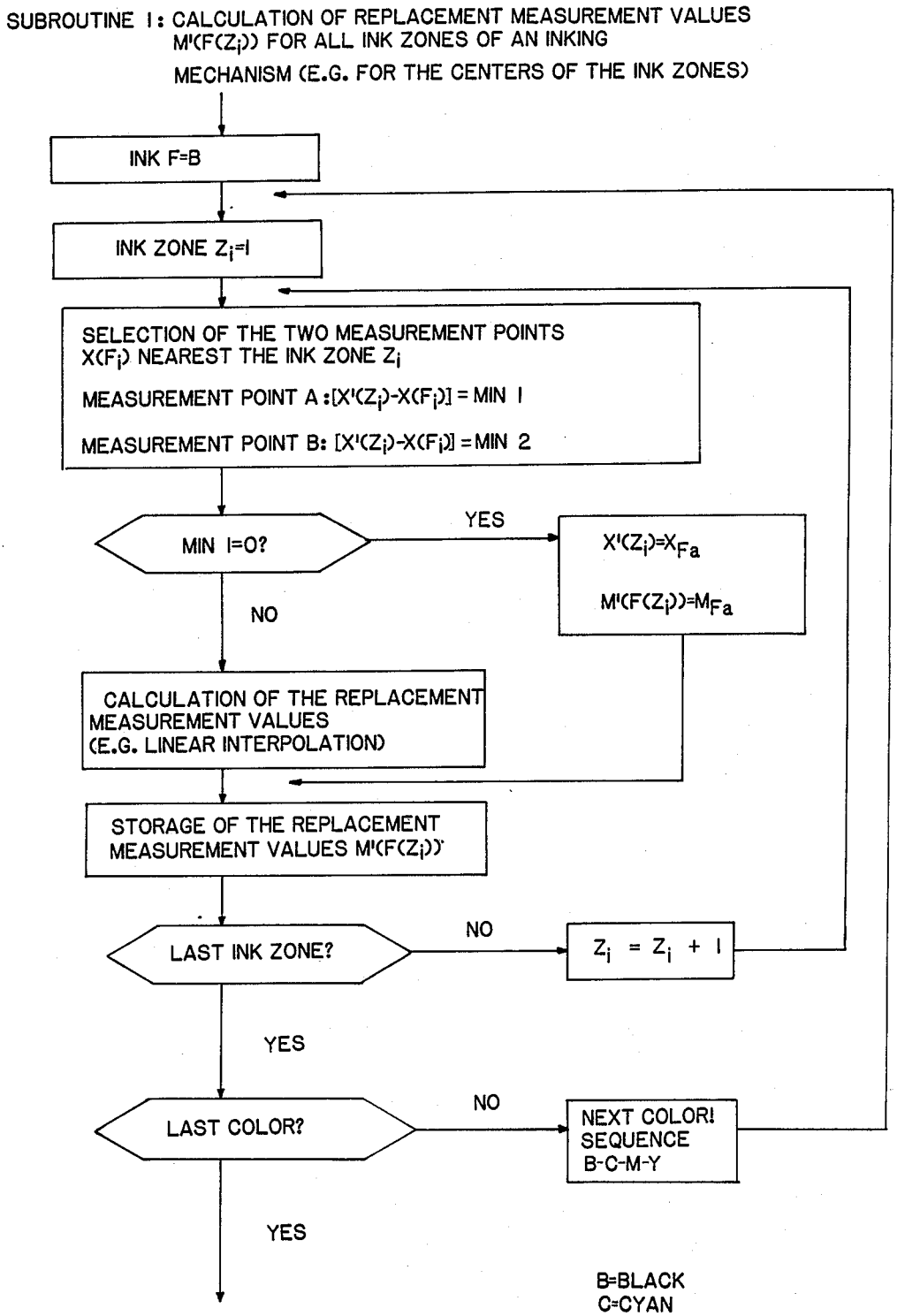
Figure 6:
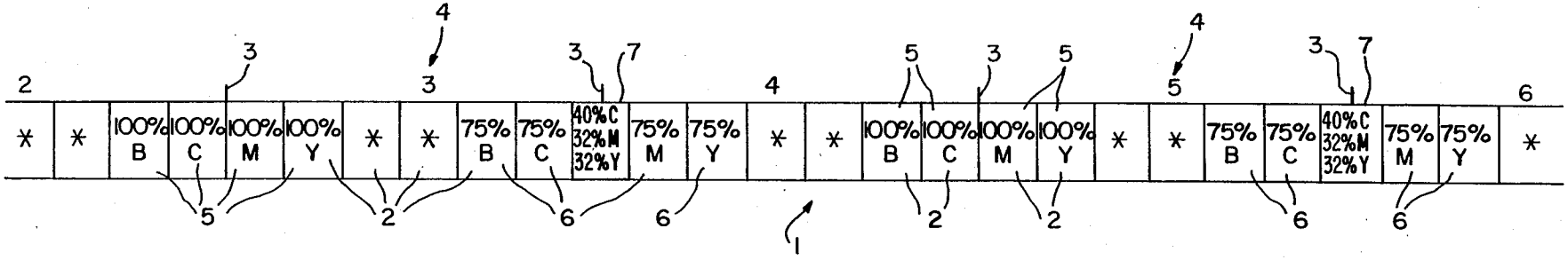
Figure 7A:
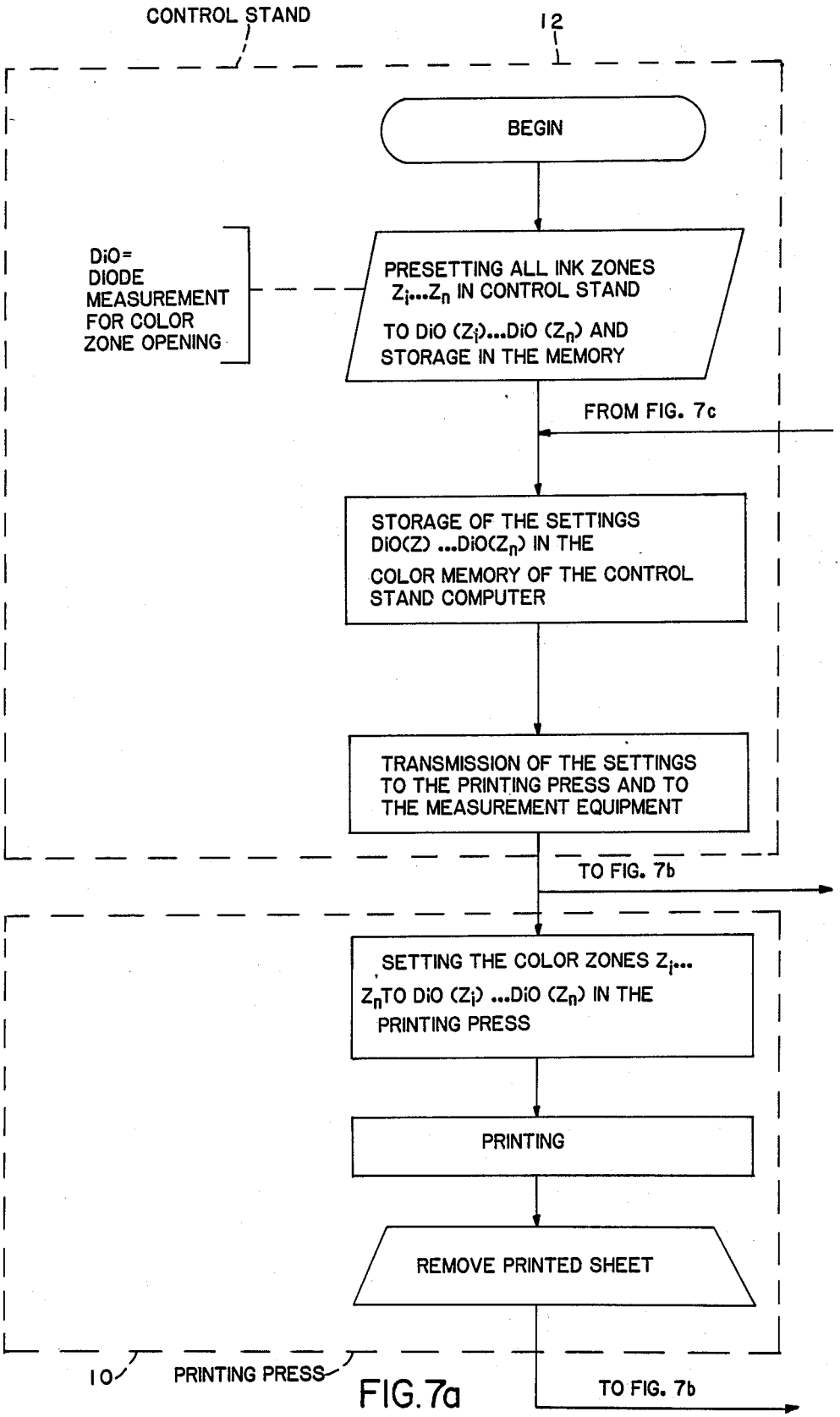
Figure 7B:
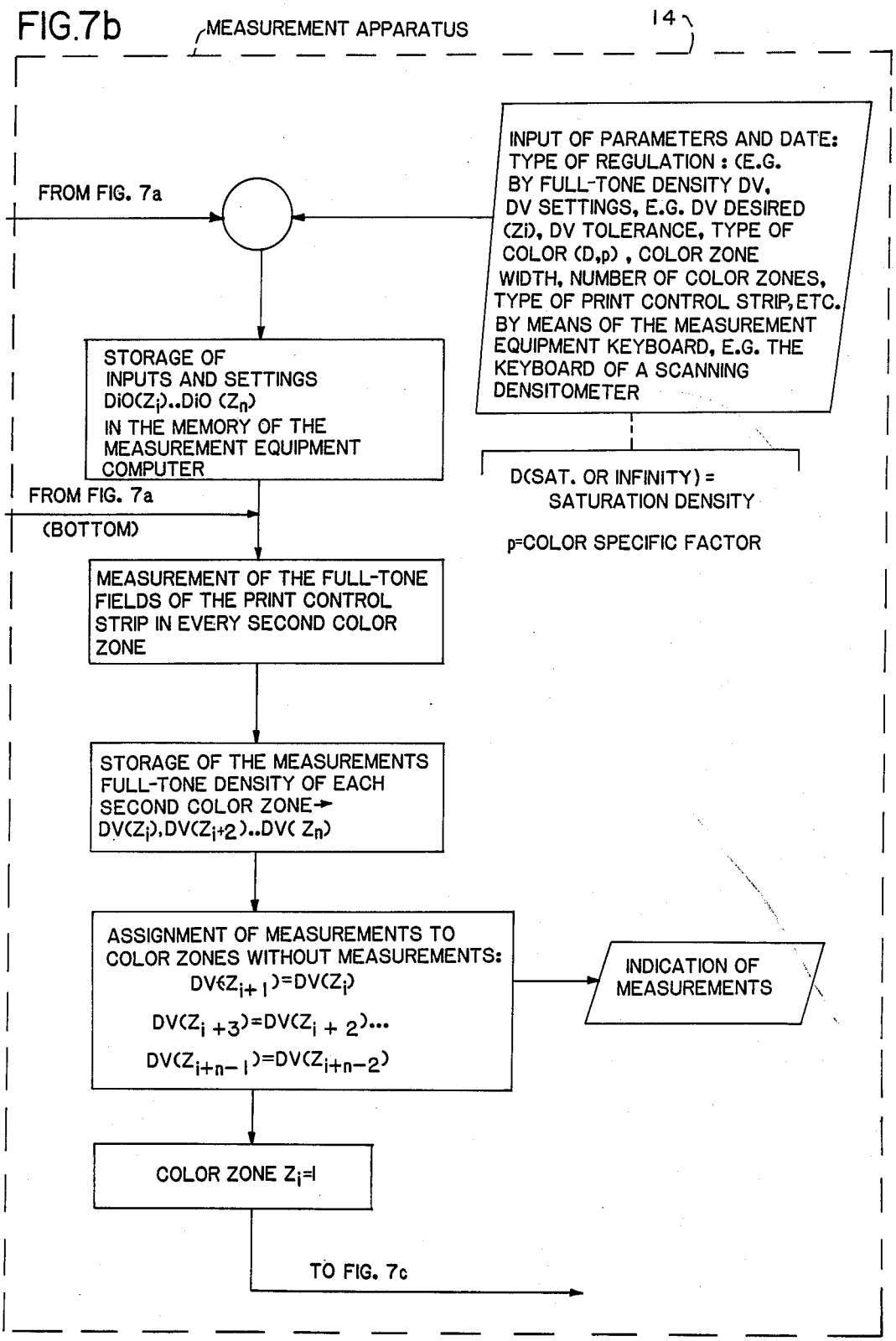
Figure 7C:
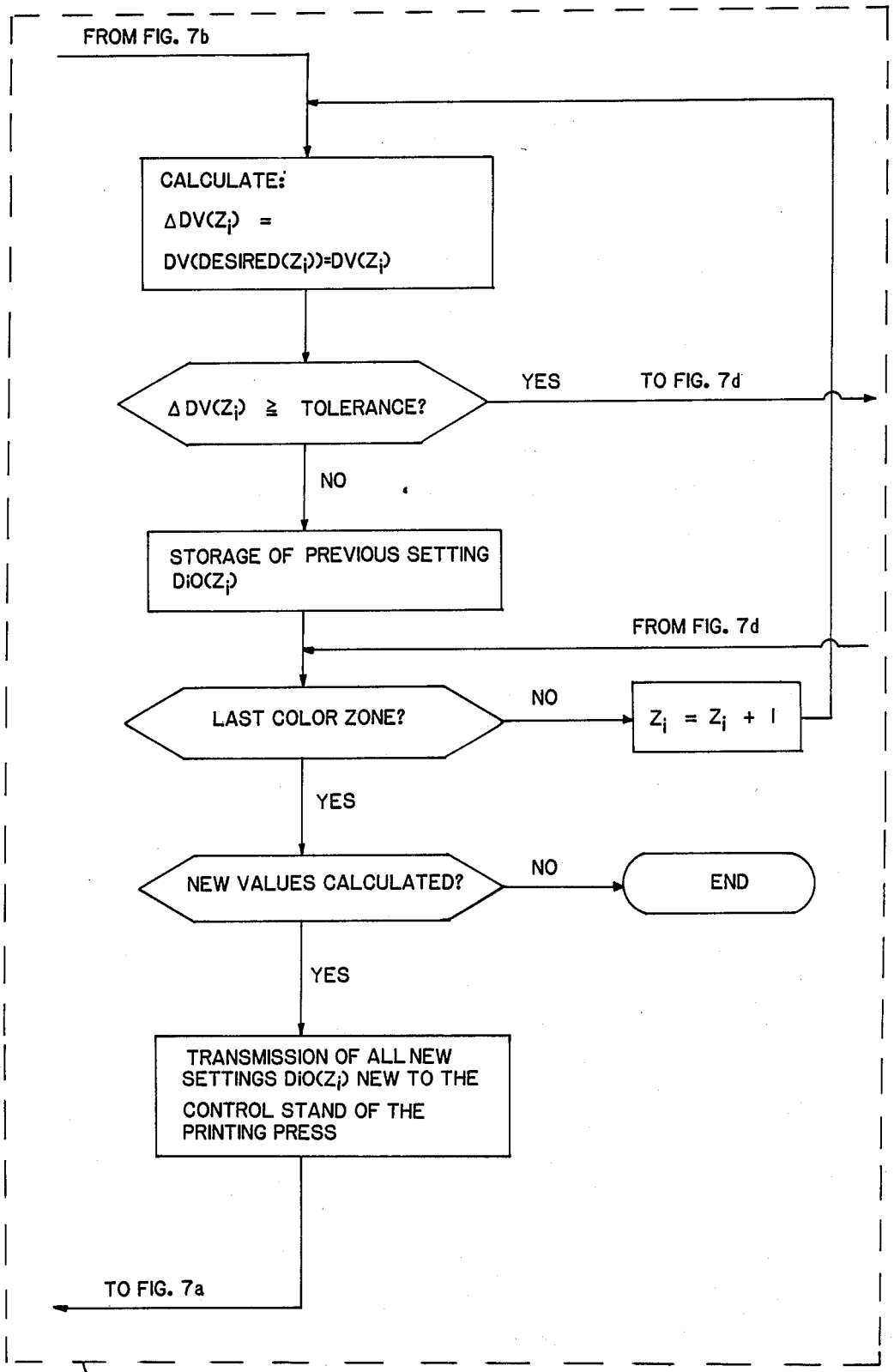
Figure 7D:
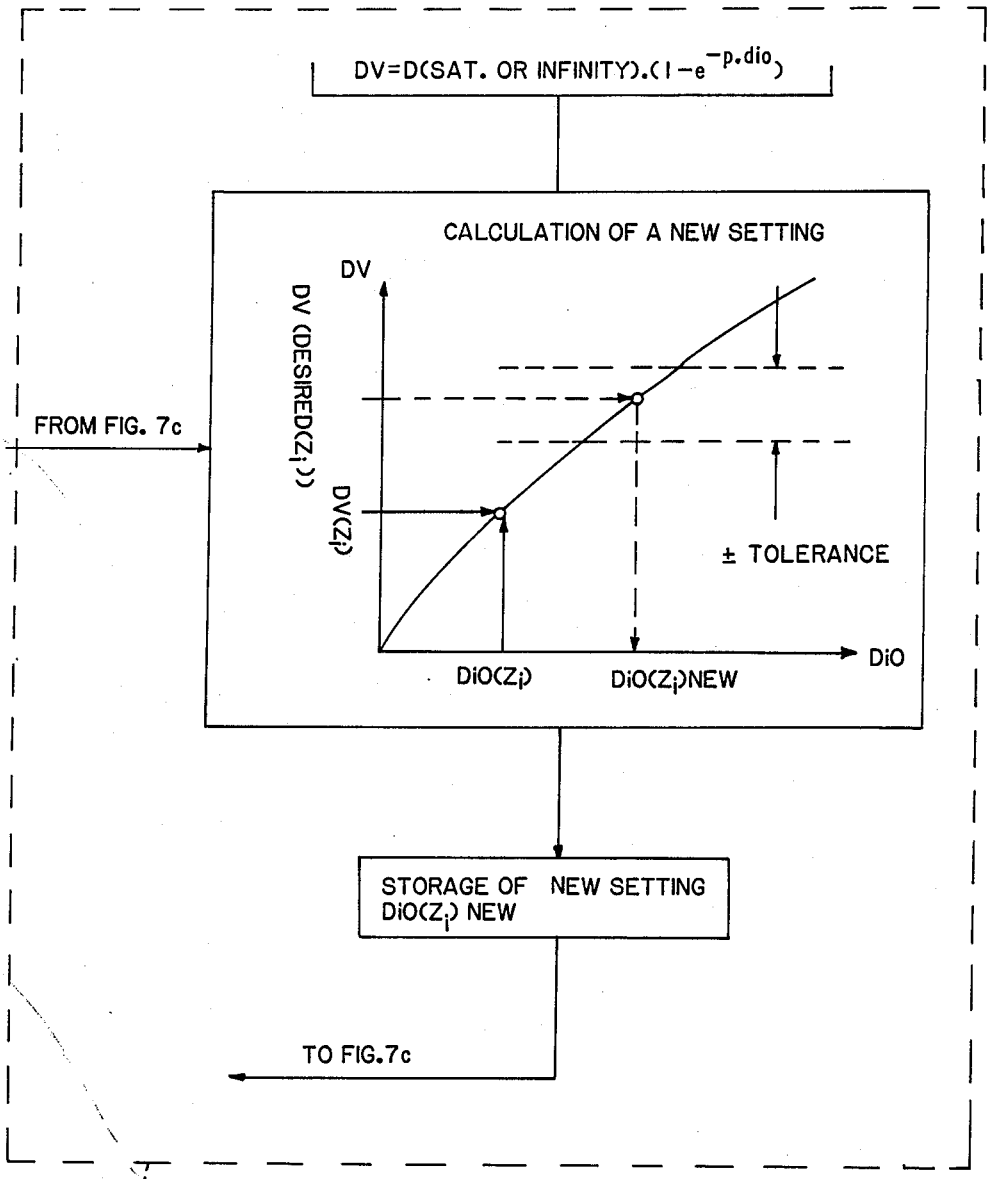

FIGS. *3a* and *3b* are a flow chart of an algorithm for implementing a measurement and adjustment process according to the invention:

FIG. 4 is a flow chart of a subroutine in the algorithm of FIG. 3;

FIGS. *5a* and *5b* are a flow chart of another subroutine in the algorithm of FIG. 3;

FIG. 6 is a schematic representation of an alternate embodiment of a print control strip; and FIGS. *7a, 7b, 7c* and *7d* are a flow chart of an algorithm for adjusting and controlling a printing process utilizing the print control strip of FIG. 6.

DESCRIPTION OF THE PREFERRED EMBODIMENTS

Print control strips are a known means for the evaluation and control of print quality in the stage prior to printing on modern printing presses. For this purpose, such print control strips have fields, which are present in varying numbers and configurations for each color to be printed (e.g., so called signal fields and measurement fields) which are evaluated on a purely visual basis. In addition, multicolor fields are also generally required for certain control operations. As a rule, a print control strip contains the following fields:

Solid tones:

one color: for measurement of the ink thickness;

two color: for measurement of the color absorption: and three color: for measurement of the color absorption and a visual evaluation of the color balance.

Halftones:

one color: for measurement of the tone value increase; and three color: for visual evaluation of the color balance.

Line screen:

one color: for visual evaluation or measurement of slip and doubling.

There can also be fields with microlines and microdots for certain purposes.

Densitometers are used almost exclusively in the prior art to measure the individual fields of the print control strip, and other color measurement devices only in special cases.

The divisions of such print control strips used for the control and/or regulation of ink delivery are adjusted to the color zone intervals of the printing press in question. In each color zone, there are single color solid tone measurement fields for zonal control/regulation according to the "Solid Tone Density DV" measurement value. The control and/or measurement fields for the evaluation of other quality criteria occur with less frequency on the print control strips.

Print control strips are well known n the art and are discussed in U.S. Pat. Nos. 3,393,618 entitled "Printing Control" and 4,469,025 entitled "Device for Mounting Print Control Strips at a Precise Level and in Registry" and in the documents "GATF Compact Color Test Strip", Zenlon Elyjin, GATF Research Progress, No. 79 (August, 1968), "A color Proofing Update", Michael H. Bruno, American Printer (July, 1985) and "Testing, Measuring, Printing—Earning Money", Heidelberg News, Issue 4 (1976) published by Heidelberger Druckmaschinen AG, D-6900 Heidelberg, Federal Republic of Germany, all of theses patents and publications being hereby expressly incorporated by reference as if the contents thereof were set forth in their entirety herein.

The print control strip 1 reproduced in FIG. 1 exhibits measurement fields 2, which are present in the illustrated embodiment in the following colors:

(B) black (C) cyan (D) magenta (Y) yellow

The ink cartridge of the corresponding printing press is divided into ink zones 3. The boundaries 4 between ink zones are indicated. A shown in FIG. 1, the lateral arrangement and frequency of the measurement fields 2 do not coincide with the ink zones 3.

Figure 1:
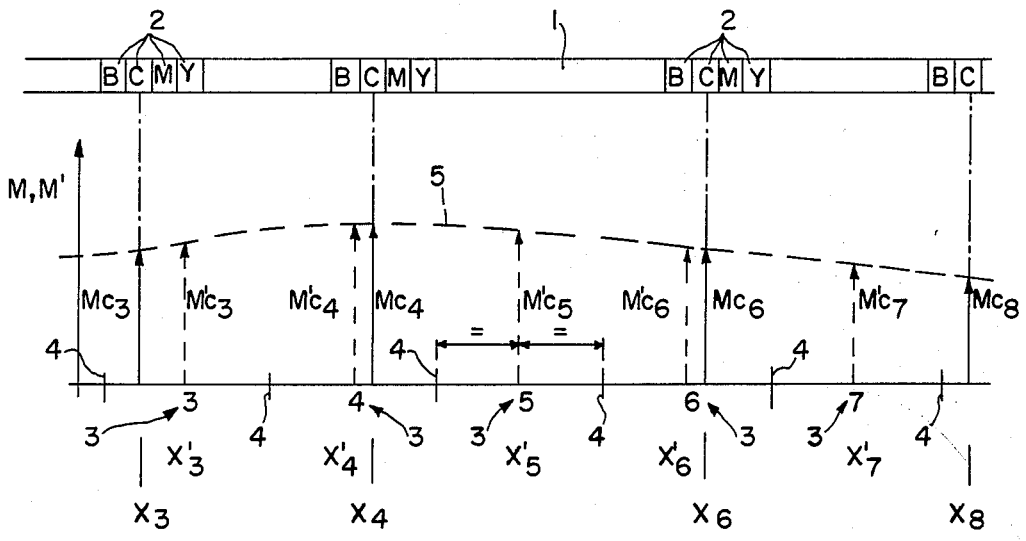
FIG. 1 shows schematically an interpolation curve according to the process.

In the embodiment illustrated in FIG. 1, the measurement values for Color C (cyan) are plotted. The measurements themselves are shown on the ordinate with the designation M, M'. The values actually measured are shown as vectors $Mc_3$, $Mc_4$, $Mc_6$ and $Mc_8$, and are stored in a measurement apparatus. The lateral positions of these measurement values $X_3$, $X_4$, $X_6$ and $X_8$ are recorded and also stored. From the measurement values and their lateral position, a computer determines an interpolation curve 5, from which the derived substitute measurement values $M'c_3$, $M'c_4$, $M'c_5$, $M'c_6$, $M'c_7$ . . . are determined for the center of each ink zone $X'_3$, $X'_4$, $X'_5$, $X'_6$, $X'_7$ . . . Then the controlled variables for each zone are computed in the same manner as previously from "genuine" measurement values.

In other words, and still referring to FIG. 1, it will be seen that the ink zones 3 extend between boundaries 4 which separate the ink zones. From a study of FIG. 1, it will also be appreciated that the measurement fields 2, for the particular print control strip 1 shown, do not align with the center points $X'_3$, $X'_4$, $X'_5$, $X'_6$, $X'_7$ . . . of the ink zones of the particular printing press being employed. Therefore, when the color measurement fields 2 on the print control strip 1 are analyzed (as, for example, when using a densitometer), the actual measured color related values $Mc_3$, $Mc_4$, $Mc_6$ and $Mc_8$ will be recorded. These actual measured color related values, however, will be related not to the center of the ink zones of the printing press being used, but rather, will be related to a series of distance measurements $X_3$, $X_4$, $X_6$ and $X_8$ which correspond to the lateral position of the actual measured color related values along the line of the consecutive ink zones.

However, in the embodiments of the present invention, it has been found that by using the actual measured color related values and by fitting a curve thereto, the thus derived empirical curve may be used to derive a series of substitute color related measurement values $M'c_3$, $M'c_4$, $M'c_5$, $M'c_6$, $M'c_7$ . . . which correspond to a close approximation of the color related measurement values at the center of each ink zone.

Figure 2:
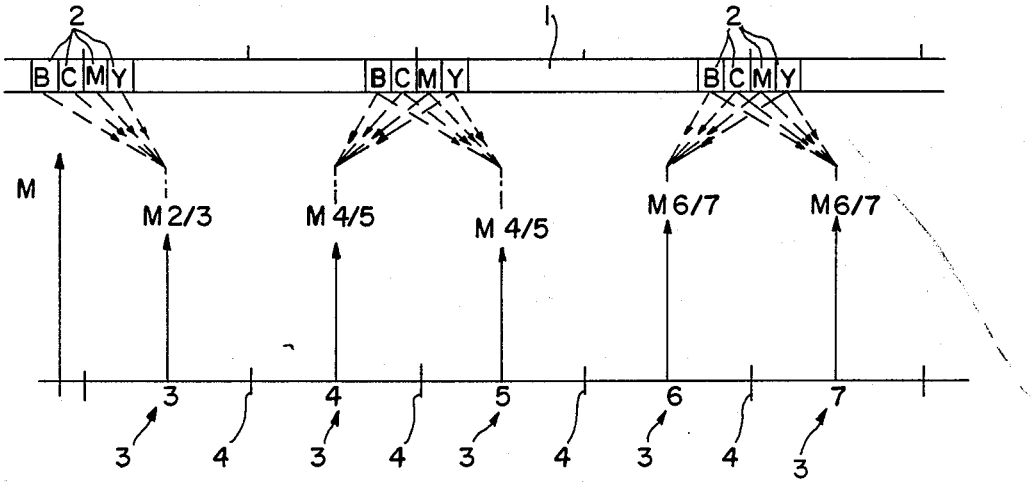
FIG. 2 shows the determination of the measurement values according to an embodiment of the invention used when the measurement fields are located near the boundaries between the ink zones.

FIG. 2 shows a printing control strip 1 with the measurement fields described above, and the ink zones 3 are listed on the abscissa located underneath. The measurements M are plotted on the ordinate, whereby the values are listed as M 2/3, M 4/5, M 6/7, which means that they were determined from the ink zones 2 and 3, 4 and 5, 6 and 7. The measurement values from the boundary area of two neighboring zones are always transferred to the ink zone center of the two neighboring zones. This simple process can be applied wherever measurement strips are used whose control/regulation fields 2 are located near the ink zone boundary 4 and correspond to the ink zone division of the machine in question.

Thus, and still referring to FIG. 2, in the situation where the measurement fields 2 of the particular print control strip 1 being used happen to be located at or near the boundaries 4 separating the ink zones 3 of the particular printing press being employed, the actual measured color related values are used for each ink zone flanking the ink zone border 4 at or near to where the measurement field 2 is located.

As a result of the proposed process, control and regulation on the basis of single zone control measurement field arrangements is also improved. This process can also be used when measurements are taken not from printing control strips, but "in the image".

FIG. 3 (i.e., FIGS. 3*a* and 3*b* viewed in conjunction with one another) depicts a flow chart relating to an algorithm used to implement the present inventive process. In FIG. 3, for purposes of illustration, the various algorithmic steps have been shown as being divided up among a printing press 10, a control stand 12 for controlling the operation of printing press 10 and a measurement apparatus 14 (for example, a scanning densitometer) having an associated input device (such as a keyboard), programmable memory and software. However, whereas the algorithm depicted in FIG. 3 (as well as associated FIGS. 4, 5*a* and 5*b*) constitutes the best mode implementation known to the inventors at the present time, other algorithms for implementing the present invention may nonetheless be equivalent to that specifically set forth and will, therefore, fall within the spirit and scope of the present invention as defined in the appended claims.

Some examples of algorithms are to be found in U.S Pat. Nos. 4,660,470 entitled "Inking Unit Pre-adjustment Method" and 4,200,932 issued Apr. 29, 1980 to Schramm, et al., which are incorporated by reference as if the contents thereof were set forth herein in their entirety.

FIG. 3 assumes that there is to be some "presetting" of the printing press variables. For example, and referring most particularly to FIG. 3*a*, initially, the following variables may be entered into the control stand 12:

- the ink zones t(i) [or $Z_i$] (i=1, 2 . . . n) for n ink zones;
- the color strip width b(F) for each color F (e.g., black, cyan, magenta and yellow, etc.) to be printed: and
- the ink metering duct settings or signals Dio($F(Z_i)$) for each ink zone $Z_i$ and each color F.

These preset values are stored in the memory of the control stand 12 and are, at an appropriate time, also transmitted to the printing press 10. Such preset values may be available due to earlier printings of the same material. They may also be derived from the output of a printing plate image reader such as the one described in the publication entitled "Heidelberg CPC", published by Heidelberger Druckmaschinen AG, D-6900 Heidelberg (Publication No. HN 2/43.e), or the one disclosed in U.S. Pat. No. 4,681,455 entitled "Method of Determining the Area of Coverage of a Printed Original or a Printing Plate for Printing Presses", equivalent to published European Patent Appln. No. 0 095 606 AZ, all of these documents being hereby expressly incorporated by reference as if set forth in their entirety herein.

In the documents incorporated immediately above, a particularly advantageous arrangement is described wherein the presetting data for a particular printing plate may be recorded on a data processing magnetic tape cassette (such as those manufactured by Hewlett Packard Company, 3000 Hanover Street, Palo Alto, Calif. 94304) which may then be used to input this data into control stand 12.

Referring now most particularly to FIG. 3*b*, various relevant parameters are also entered into measurement apparatus 14 via the associated input device and are stored in the programmable memory provided therewith. For example, the following parameters may be entered:

- the type of control to be employed, for example, solid tone density DV or halftone density DR;
- the desired color related values for each color M(Fset(i));
- the allowed tolerance F for each color;
- the saturation density M'(F) and the color specific factor P(F) for each color F;
- specific variables relating to the particular printing press 10 being used, for example, the number of ink zones $Zn_1$ and the position of the center points of the ink zones $X'(Z_i)$; and
- specific variables relating to the type of print control strip being used, for example, the position of the color measurement fields $X(F_i)$.

A number of preproduction sheets are now printed sufficient to allow some stabilization of the printing process, whereupon a printed sheet is removed from the printing press 10 and transferred to the measurement apparatus 14. There, the print control strip produced on the printed sheet (such as is schematically shown in FIG. 1) is analyzed by the measurement apparatus 14 which produces a series of paired values $M(F_i)$, $X(F_i)$, the actual color related measured value and its actual position for each appearance of each color on the print control strip. The positions $X(F_i)$ may conveniently, if desired, be related to the middle of the printed sheet. These paired actual color related measured values and positions are then sorted by color F so as to yield a series of measured data points across the width of the printed sheet.

By use of an interpolation routine, the substitute color related measured values $M'(F(Z_i))$ are now calculated for the center of each ink zone $X'(Z_i)$. To this end, a linear interpolation subroutine, indicated as Subroutine 1, which may be employed, is more particularly illustrated in FIG. 4. However, it is to be understood that the present invention is not limited to the use of linear interpolation, but rather, it is contemplated that other well known, nonlinear interpolation techniques could also be employed without departing from either the spirit or the scope of the present invention. Interpolation techniques are taught in U.S. Pat. Nos. 4,670,892 entitled "Method and Apparatus for Computed Tomography of Portions of a Body Plane", 4,449,196 entitled "Data Processing System for Multi-Precision Arithmetic" and 4,682,894 entitled "Calibration of Three-Dimensional Space", all of which are incorporated by reference as if the contents thereof were fully set forth herein.

Referring now to FIG. 4, it will be seen that the substitute color related measured values $M'(F(Z_i))$ are calculated, through the use of well known incrementation techniques, for each ink zone $Z_i$ and for each ink color F=B, C, M, Y, etc. For each ink zone center of each color, two measurement points, measurement point a and measurement point b are selected. Measurement point a relates to the absolute value $[X'(Z_i)-X(F_i)]=\min 1$, and measurement point b relates to the absolute value $[X'(Z_i)-X(F_i)]=\min 2$. The values min 1 and min 2 represent the distances from the center point of the ink zone $X'(Z_i)$ to the nearest actual measured color related value on opposing sides of the corresponding ink zone center. The value min 1 is then tested as to whether or not it has a value of zero. If so, indicating that the ink zone center coincides with measurement point a, interpolation becomes unnecessary for this particular data point, and the actual measured position and color related value are stored as the substitute measured values for this particular data point.

If the testing on min 1 yields a non-zero value, then subroutine 1 performs a linear interpolation between measurement points a and b (the two nearest actual measured values flanking, on opposite sides, the center of the ink zone) to derive a substitute measured value $M'(F(Z_i))$ for the center point $X'(Z_i)$ of the ink zone.

The following example illustrates the calculation of the substitute measurement value $M'_{C5}$ according to subroutine 1 of FIG. 4 and in accordance with the particular parameters shown in FIG. 1. Here the color F is chosen to be cyan C. Moreover, whereas the following example utilizes linear interpolation, as noted above, the use of other well known nonlinear interpolation techniques are contemplated as being within the scope of the present invention.

EXAMPLE

| Example: | | | |
|---|---|---|---|
| Measured are: | $M_{C3}$ = 1.35 D | $X_3$ = | 63.5 mm |
| | $M_{C4}$ = 1.60 D | $X_4$ = | 103 mm |
| | $M_{C6}$ = 1.35 D | $X_6$ = | 160 mm |
| | $M_{C8}$ = 1.05 D | $X_8$ = | 203.5 mm |
| Color zone centers given as: | | $X'_3$ = | 71 mm |
| | | $X'_4$ = | 99.5 mm |
| | | $X'_5$ = | 128 mm |
| | | $X'_6$ = | 156.5 mm |
| | | $X'_7$ = | 185 mm |
| Color F = C (Cyan) | | | |
| Color zone i = 5 | | | |

Nearest measurement points $X_{Ci}$

Nearest measurement points $X_{Ci}$:
Meas. Pt. a: absolute value $[X'_5 - X_4] = 25$ mm = min 1
Meas. Pt. b: absolute value $[X'_5 - X_6] = 32$ mm = min 2
min 1 = 0 → no $$M_{Fa} = M_{C4}\,;\ X_{Fa} = X_4$$
$$M_{Fb} = M_{C6}\,;\ X_{Fb} = X_6$$
$$X'(Z_i) = Z'_5$$

$$M'(F(Z_i)) = M_{Fa} + (M_{Fb} - M_{Fa}) \cdot \frac{X'(Z_i) - X_{Fa}}{X_{Fb} - X_{Fa}}$$

$$M'_{C5} = M_{C4} + (M_{C6} - M_{C4}) \cdot \frac{X'_5 - X_4}{X_6 - X_4}$$

$$M'_{C5} = 1.60 + (1.35 - 1.60) \cdot \frac{128 - 103}{160 - 103}$$

$$M'_{C5} = 1.49$$

By well known incrementation techniques, the substitute measurement values $M'(F(Z_i))$ are determined for each ink zone of each color.

Figure 5A:
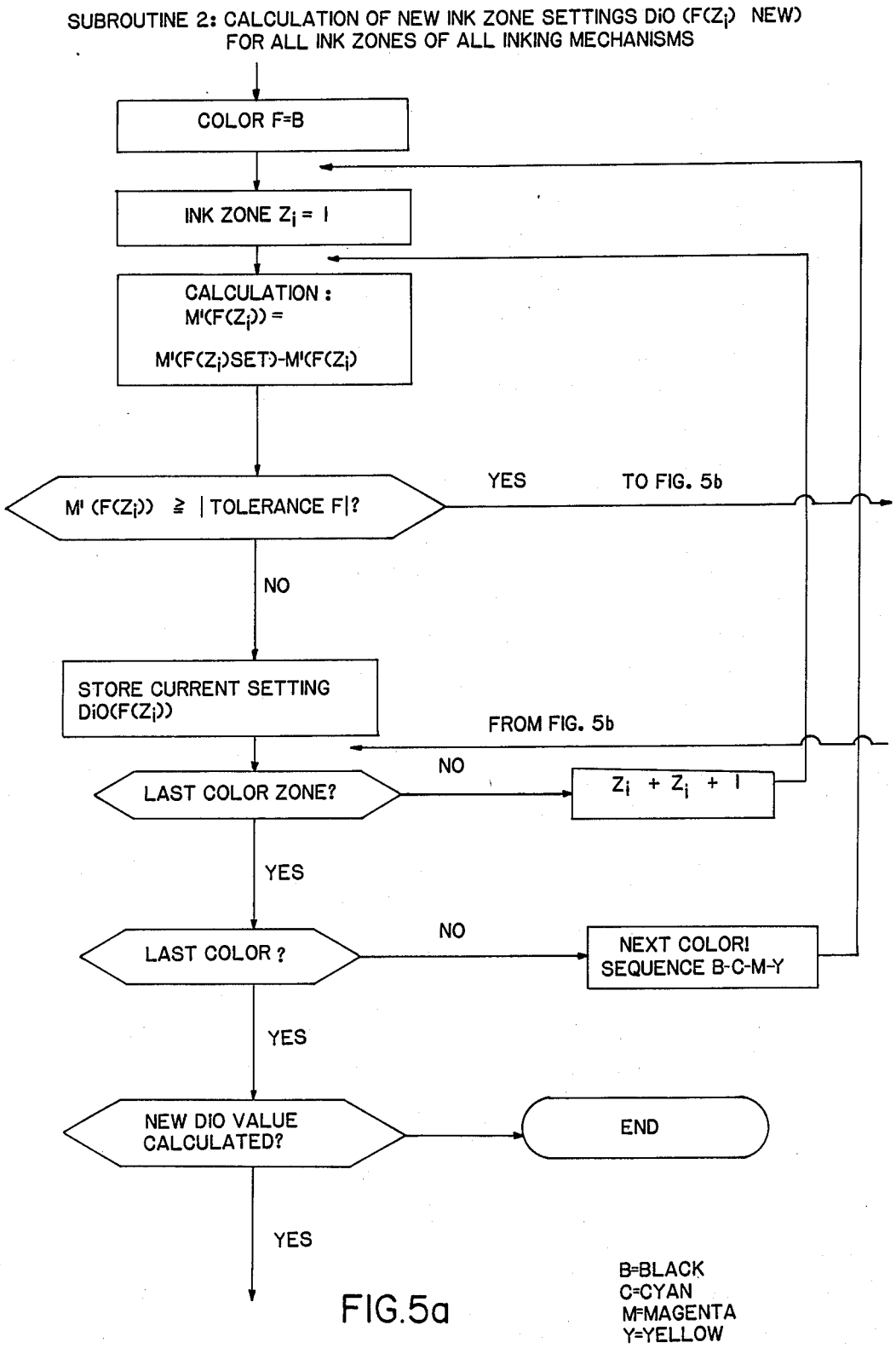
Figure 5B:
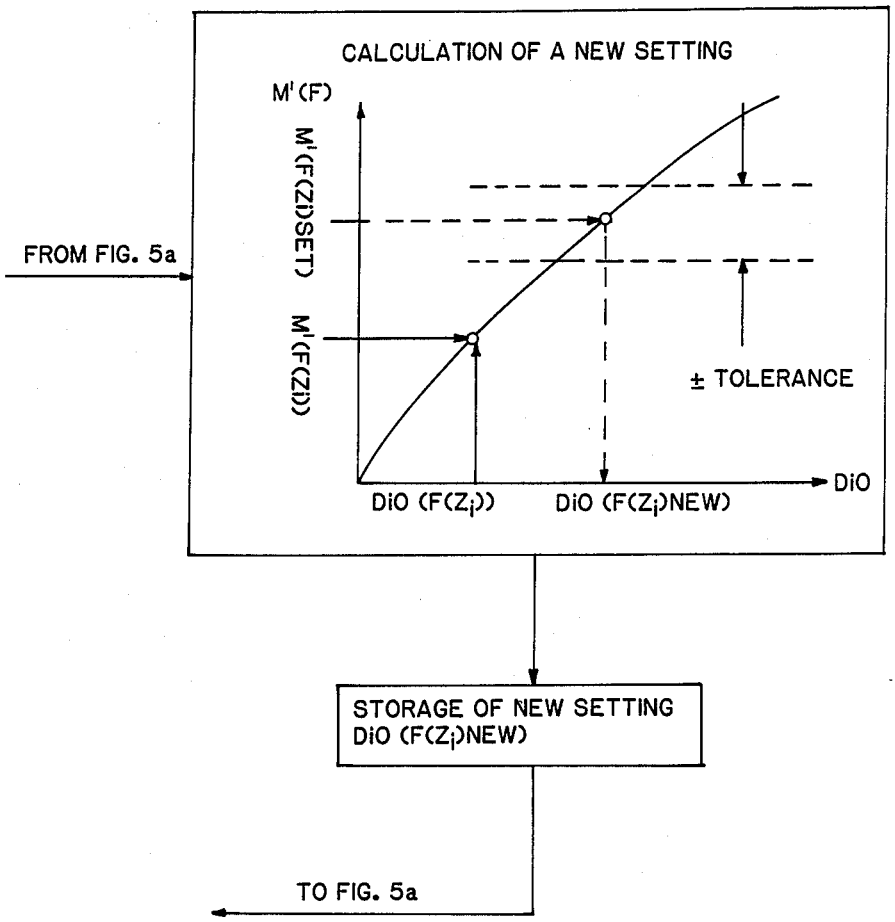

As noted on FIG. 3*b*, once the substitute measured values have been determined and stored for each ink zone of each color, a subroutine 2, shown most particularly in FIGS. 5*a* and 5*b*, calculates new (or updated) ink metering duct settings $Dio(F(Z_i)new)$ for each ink metering duct corresponding to each ink zone.

The operation of ink metering ducts which control the amount of ink applied in the various ink zones are shown, for example, in the above incorporated by reference U.S. Pat. No. 4,660,470 and "Heidelberg CPC" publication.

Referring now to FIG. 5 (i.e., FIGS. 5*a* and 5*b* viewed in conjunction with one another), it will be seen that a subroutine designated as subroutine 2 calculates new ink metering duct settings $Dio(F(Z_i)new)$ for each ink color (black, cyan, magenta, yellow, etc.) and for each ink zone $Z_i$ thereof. The differences between the desired substitute measured color related values $M'(F(Z_i)set)$ and the actual substitute measured color related values $M'(F(Z_i))$ output from subroutine 1 are determined. These differences are then compared to determine whether they exceed a tolerance factor F. If the tolerance factor F is not exceeded, then the current ink metering duct setting $Dio(F(Z_i))$ is again stored in memory. If, on the other hand, the tolerance F is exceeded, then subroutine 2 reverts to an empirical curve stored in the memory of measurement apparatus 14. In a preferred embodiment, this empirical curve is stored in memory as a look up table. Through the use of iteration procedures well known in the art, a new ink metering duct setting $Dio(F(Z_i)new)$ is calculated so as to produce successive approximations to the ink metering duct setting which will yield the desired substitute measured color related value $M'(F(Z_i)set)$. Iteration techniques are taught in U.S. Pat. Nos. 4,696,015, entitled "Echo Correction Especially for Television Broadcast Systems", 3,903,399, entitled "System and Method for Converging Iterations and Hybrid Loadflow Computer Arrangement", and 3,886,332, entitled "Application of Basecase Results to Initiate Iterations and Test for Convergence in a Hybrid Computer Arrangement Used to Generate Rapid Electric Power System Loadflow Solutions", all of which are hereby expressly incorporated by reference as if the contents thereof were fully set forth in their entirety herein.

This new ink metering duct setting $Dio(F(Z_i)new)$ is then stored in memory. By incrementation, the appropriate updated ink metering duct settings are determined for each ink zone of each ink color, and the updated ink metering duct settings are stored in the memory of the control stand 12 and transmitted to the printing pres 10 itself. This process is continued, at appropriate intervals, for succeeding sheets printed on the printing press 10 until adequate agreement exists between the desired color related values of the control strip and the measured values thereof.

Referring back now to FIG. 3, it will be seen that the updated ink metering duct settings $Dio(F(Z_i)new)$ for each ink zone of each ink color are transmitted back to the printing press control stand 12 and thence to the printing press 10 itself. The process of printing, analyzing a print control strip on a printed sheet and adjusting the ink metering duct settings based on such analysis as described above may be repeated until a desired degree of quality has been achieved. In practice, it has been found that the process according to the present invention converges quite rapidly to production run quality. Thereafter, measurement apparatus 14 may be conveniently used, as necessary, to monitor the quality of the production run.

While the algorithm set forth in FIGS. 3–5 has been described with respect to a process which includes presetting, convergence to production quality and production run monitoring, it is clear that the principles thereof may be adapted for use in any one particular aspect of this process, and such adaptation and use is contemplated as being within the scope of the present invention.

Referring now to FIG. 6, another print control strip 1 has individual color fields 2 of different colors and structure arranged in a row. For purposes of explanation, boundary lines 3 have been drawn, which divide the ink zones of the ink duct of a printing press. The individual ink zones are numbered sequentially by numbers 4. In the vicinity of the boundary lines 3 between two ink zones, the print control strip has alternating single color solid tone fields 5 for each ink color and single color halftone fields 6 for each ink color. The single color halftone fields 6 are hereby advantageously configured as dot halftone fields. Both the solid tone fields 5 and the halftone fields 6 are arranged alternately over the length of the print control strip 1. In addition, corresponding to every second zone between the halftone fields 6, there are multicolor dot halftone fields 7 in the vicinity of the boundary lines 3. In the embodiment of FIG. 6, the total covered surface in each multicolor dot halftone field 7 is almost the same as the covered surface in the single color dot halftone fields 6, and preferably in the three-quarter tone range; it is unimportant whether a dot halftone field is executed with 75 percent halftone tone value of one color or, like the dot halftone field 7 shown in the embodiment of FIG. 6, as a three color halftone field, with 40 percent cyan, 32 percent magenta and 32 percent yellow.

The necessary surface coverage of the individual ink separations and all the partial surfaces which result in the compression can be determined according to the "Neugebauer Equation". If, for example, we consider a 15 percent to 40 percent halftone tone value, then we get the following halftone fields with the same surface coverage in the printing.

- Single color dot halftone fields: 75% halftone tone value
- Two color dot halftone fields: 2×48% halftone tone value
- Three color dot halftone fields: 3×35% halftone tone value The proportion of white paper in all cases is approximately 13 percent.

Multicolor halftone fields configured in this manner also have the advantage that they do not overvalue color shifts by changes in the color absorption behavior.

Since three color halftone fields are also used advantageously for visual evaluation, the surface coverage of the individual colors should preferably be tuned to grey, which reacts in a manner particularly sensitive to the color cast. For example, under normal conditions, and also with approximately 13 percent white paper, a grey in the print would result for the following halftone tone values in the film:

- Cyan: 40 percent
- Magenta: 32 percent
- Yellow: 32 percent

FIG. 7 (i.e., FIGS. *7a, 7b, 7c* and *7d* viewed in conjunction with one another) depicts a flow chart of an algorithm used to monitor and adjust a printing process employing the printing control strip shown in FIG. 6. In FIG. 7, for purposes of illustration, the various algorithmic steps have been shown as being divided up among a printing press 10, a control stand 12 for controlling the operation of printing press 10 and a measurement apparatus 14 (for example, a scanning densitometer) having an associated input device (such as a keyboard), programmable memory and software. However, whereas the algorithm depicted in FIG. 7 constitutes the best mode implementation known to the inventors at the present time, other algorithms for implementing the present invention may nonetheless be equivalent to that specifically set forth and will, therefore, fall within the spirit and scope of the present invention as defined in the appended claims.

FIG. 7 assumes that there is to be some "presetting" of the printing press variables. For example, and referring now most particularly to FIG. *7a*, the ink metering duct settings $Dio(Z_i)$ for each ink zone $Z_i$ and each color F may be entered. Additionally, the color strip width b(F) for each color F, as well as other pertinent variables relating to the printing stands could be entered.

As discussed above, such preset values may be available from earlier printings of the same material, or may be derived from the output of a printing plate image reader such as the one described in the aforementioned publications which have been incorporated by reference. These preset values are stored in the memory of the control stand 12 and are transmitted to the printing press 10 and the memory of the measurement apparatus 14 at an appropriate time.

As shown in FIG. *7b*, various relevant parameters are also entered into measurement apparatus 14 via the associated input device and are stored in the programmable memory provided therewith. For example, the following parameters may be entered:

- the type of control to be employed, for example, solid tone density DV or halftone density DR;
- the desired target solid tone density levels [e.g., DV desired ($Z_i$)] for each ink zone $Z_i$ of each color F;
- parameters relating to each color F, for example, the saturation density [e.g., D(sat. or infinity)] and the color specific factor p;
- specific variables relating to the particular printing press 10 being used, for example, the number of ink zones and the widths thereof; and
- specific variables relating to the type of print control strip being used.

In the algorithm illustrated in FIG. 7, it is assumed that the printing process is being adjusted and/or monitored through. the use of solid tone density (or DV) control. However, it will be understood by those of ordinary skill in the art that an analogous procedure can be employed where adjustment is being carried out using halftone density (or DR) or a combination of solid tone density DV and halftone density DR, or even further, where the printing procedure is being controlled according to a colorimetric analysis of the multicolor halftone fields 7 of the print control strip shown in FIG. 6.

A number of preproduction sheets are now printed sufficient to allow some stabilization of the printing process, whereupon a printed sheet is removed from the printing press 10 and transferred to the measurement apparatus 14. There, the print control strip (shown schematically in FIG. 6) which is produced on the printed sheet is analyzed by the measurement apparatus 14 which reads and stores in its associated memory a solid tone density DV measurement for every other or second ink zone, e.g., $DV(Z_i)$, $DV\ Z_{i+2}$) . . . DV As noted above, such "two zone measurement" process takes advantage of the fact that there are not any abrupt transitions in the ink distribution and therefore reduces by approximately half, the number of required measurements.

The ink zones in which measurements were not recorded are now assigned the solid tone density value of an adjacent ink zone in which a measurement was recorded. That is, for example: $DV(Z_{i+1})=DV(Z_i)$, $DV(Z_{i+3})=DV(Z_{i+12})$ . . . and $DV(Z_{i+n-1})=DV(Z_{in+-2})$.

The updated ink metering duct settings $Dio(Z_i)$new are now calculated as shown in FIGS. *7c* and *7d*. Through the use of incrementation techniques, the updated ink metering duct settings are calculated for each ink zone $Z_i$ of each color F. The difference between the desired solid tone density and the actual measured solid tone density, i.e., DV desired$(Z_i)-DV(Z_i)$, is determined for each ink zone. This calculated deviation is then compared to a "Tolerance" factor. If the "Tolerance" factor is not exceeded, then the previous ink metering duct setting $Dio(Z_i)$ is stored as the updated ink metering duct setting $Dio(Z_i)$new. If however, the tolerance factor is exceeded, then a new ink metering duct setting is calculated through use of a curve stored in the memory of measurement apparatus 14. In a preferred embodiment, this curve is stored in memory as a look-up table, and is of the general form of DV=D(sat. or infinity).$(1\text{-}e^{-p.Dio})$. Through the use of iteration procedures well known in the art, a new ink metering duct setting $Dio(Z_i)$new is calculated so as to produce successive approximations to the ink metering duct setting which will yield the desired solid tone density measurement DVdesired$(Z_i)$.

The updated ink metering duct settings $Dio(Z_i)$new for each ink zone $Z_i$ of each ink color F are transmitted back to the printing press control stand 12 and thence to the printing press 10 itself. The process of printing, analyzing a print control strip on a printed sheet and adjusting the ink metering duct setting based on such analysis as described above, may be repeated until a desired degree of quality has been achieved. In practice, it has been found that the process according to the present invention converges quite rapidly to production run quality. Thereafter, measurement apparatus 14 may be conveniently used, as necessary, to monitor the quality of the production run.

While the algorithm set forth in FIG. 7 has been described with respect to a process which includes presetting, convergence to production quality and production run monitoring, it is clear that the principles thereof may be adapted for use in any one particular aspect of this process, and such adaptation and use is contemplated as being within the scope of the present invention.

The invention as described hereinabove in the context of the preferred embodiments is not to be taken as limited to all of the provided details thereof, since modifications and variations thereof may be made without departing from the spirit and scope of the invention.

What is claimed is:

1. A process for controlling the application of at least one ink in a printing press, said printing press having a plurality of ink metering ducts arranged laterally with respect to said printing press, each of said plurality of ink metering ducts substantially defining an ink zone of said printing press, each of said ink zones having a coordinate $X'_i$ representing the lateral position of its center point with respect to said printing press, said process comprising the steps of:

(a) producing a print control strip with said printing press, said print control strip having printed thereon, by said printing press, a plurality of measurement fields of said at least one ink, each of said measurement fields having a coordinate $X_i$ representing its lateral position with respect to said printing press;

(b) analyzing said plurality of measurement fields produced on said print control strip to obtain a plurality of color related values $M_i$, each color related value $M_i$ being indicative of the application of said at least one ink within said printing press at each of said lateral positions $X_i$;

(c) fitting a mathematical curve to said measured values $X_i$ and $M_i$;

(d) determining values $M'_i$ of said mathematical curve at said coordinates $X'_i$ representing the lateral positions of said ink zones with respect to said printing press; and (e) adjusting said ink metering ducts in accordance with said determined values $M'_i$;

2. The process according to claim 1, wherein adjusting step (e) comprises the substeps of:

(e1) comparing said determined values $M_i$ with set color related values $M'set_i$; and (e2) adjusting said ink metering ducts to converge said determined values $M'_i$ with said set color related values $M'set_i$.

3. The process according to claim 1, wherein said adjusting step (e) is carried out using an empirically determined relationship between said determined values $M'_i$ and the range of settings of said ink metering ducts.

4. The process according to claim 2, wherein said adjusting step (e) is carried out using an empirically determined relationship between said determined values $M'_i$ and the range of settings of said ink metering ducts.

5. The process according to claim 3, wherein said empirically determined relationship is stored in a programmable memory as a look up table.

6. The process according to claim 4, wherein said empirically determined relationship is stored in a programmable memory as a look up table.

7. The process according to claim 2, wherein said adjusting and converging step (e2) is carried out using an iteration technique.

8. The process according to claim 4, wherein said adjusting and converging step (e2) is carried out using an iteration technique.

9. The process according to claim 1, wherein said measured color related values $M_i$ are representative of the density of said at least one ink in said measurement fields.

10. The process according to claim 2, wherein said measured color related values $M_i$ are representative of the density of said at least one ink in said measurement fields.

11. The process according to claim 3, wherein said measured color related values $M_i$ are representative of the density of said at least one ink in said measurement fields.

12. The process according to claim 7, wherein said measured color related values $M_i$ are representative of the density of said at least one ink in said measurement fields.

13. The process according to claim 2, comprising the additional steps of:

determining the difference between determined values $M'_i$ and said set color related values $M'set_i$; and adjusting said ink metering ducts according to step (e2) only if said difference is at least as great as a tolerance factor.

14. The process according to claim 4, comprising the additional steps of:

determining the difference between determined values $M'_i$ and said set color related values $M'set_i$; and adjusting said ink metering ducts according to step (e2) only if said difference is at least as great as a tolerance factor.

15. The process according to claim 7, comprising the additional steps of:

determining the difference between determined values $M'_i$ and said set color related values $M'set_i$; and adjusting said ink metering ducts according to step (e2) only if said difference is at least as great as a tolerance factor.

16. The process according to claim 1, wherein said process is carried out for a plurality of inks used in said printing press, the application of each of said inks being controlled according to said recited process.

17. The process according to claim 2, wherein said process is carried out for a plurality of inks used in said printing press, the application of each of said inks being controlled according to said recited process.

18. The process according to claim 8, wherein said process is carried out for a plurality of inks used in said printing press, the application of each of said inks being controlled according to said recited process.

19. A process for controlling the application of at least one ink in a printing press, said printing press having at least two ink metering ducts arranged laterally with respect to said printing press, each of said at least two ink metering ducts substantially defining a corresponding ink zone of said printing press, each of said at least two ink zones being consecutive and adjacent to one another and having coordinates $X'_i$ and $X'_{i+1}$ which represent the lateral position of the center point of each ink zone with respect to said printing press, said at least two ink zones being separated by a boundary area, said process comprising the steps of:

(a) producing a print control strip with said printing press, said print control strip having printed thereon by said printing press at least one measurement field of said at least one ink, said at least one measurement field being positioned laterally with respect to said printing press adjacent said boundary area between said at least two consecutive and adjacent ink zones;

(b) analyzing said at least one measurement field to obtain a common color related value indicative of the application of said at least one ink at substantially the lateral position of said measurement field, said common color related value being common to both of said two consecutive and adjacent ink zones;

(c) assigning said obtained common indicative color related value to the center points $X'_i$ and $X'_{i+1}$ of each of said at least two consecutive and adjacent ink zones; and (d) adjusting the ink flow in each of said at least two corresponding ink metering ducts based on said common assigned color related value.

20. The process according to claim 19, wherein said process is carried out for a plurality of inks used in said printing press, the application of each of said inks being controlled according to said process.

21. A process for controlling the application of at least one printing medium to a receptor for receiving said at least one printing medium in a printing device, said printing device having printing medium metering means for metering said at least one printing medium to a plurality of printing medium zones arranged in a geometrical configuration with respect to said printing receptor, each of said printing medium zones having a coordinate $X'_i$ representing the spatial position of a predetermined area of said printing medium zone with respect to said printing receptor, said process comprising the steps of:

(a) producing a print control image means with said printing device, said print control image means having printed thereon, by said printing device, a plurality of measurement fields of said at least one printing medium, each of said measurement fields having a coordinate $X_i$ representing its spatial position with respect to said printing receptor;

(b) analyzing said plurality of measurement fields produced on said print control image means to obtain a plurality of printing medium related values $M_i$, each printing medium related value $M_i$ being indicative of the application of said at least one printing medium at each of said spatial positions $X_i$;

(c) relating a numerical function to said measured values $X_i$ and $M_i$;

(d) determining values $M'_i$ of said numerical function at said coordinates $X'_i$ representing the spatial positions of said predetermined areas of said printing medium zones with respect to said printing receptor; and (e) adjusting said printing medium metering means in accordance with said determined values $M'_i$.

* * * * *